US005188243A

United States Patent [19]

Ruiz

[11] Patent Number: 5,188,243

[45] Date of Patent: Feb. 23, 1993

[54] GOLF CLUB HOLDER

[76] Inventor: Carlos D. Ruiz, 520 NW. 103rd Ter., Pembroke Pines, Fla. 33026

[21] Appl. No.: 736,942

[22] Filed: Jul. 29, 1991

[51] Int. Cl.[5] ..... A63B 55/00

[52] U.S. Cl. ..... 211/70.2; 248/96; 206/315.3

[58] Field of Search ..... 211/70.2; 248/95, 96, 248/97; 206/315.3; 383/6, 13

[56] References Cited

U.S. PATENT DOCUMENTS

| | | | |
|---|---|---|---|
| 1,696,062 | 12/1978 | Thurlow et al. | 248/96 |
| 1,880,351 | 10/1932 | McDonald | 248/96 |
| 2,091,298 | 8/1937 | Agnew | 211/70.2 X |
| 2,595,987 | 5/1952 | Shears | 211/70.2 X |
| 2,781,072 | 2/1957 | Kouke | 211/70.2 X |
| 2,860,679 | 11/1958 | Kouke | 211/70.2 |
| 2,863,483 | 12/1958 | Fargo | 211/70.2 |
| 3,316,951 | 5/1967 | Jacobson | 206/315.3 |
| 3,966,051 | 6/1976 | Hollister et al. | 211/70.2 X |
| 4,181,167 | 1/1980 | Ret | 211/70.2 X |
| 4,968,048 | 11/1990 | Lortie | 211/70.2 |

*Primary Examiner*—Carl D. Friedman
*Assistant Examiner*—Korie H. Chan
*Attorney, Agent, or Firm*—Oltman and Flynn

[57] ABSTRACT

A golf club holder having a plurality of parallel tubes for receiving golf club shafts, combined with an arrangement for bundling the tubes, and further having a carrying arrangement for carrying the golf club holder which includes golf bag and a single carrying strap which can be attached to and removed from the golf club holder and then attached to the golf bag for carrying the golf bag. According to a further feature, the golf club holder includes a plurality of perforated tube separators in the bundling arrangement spaced axially in the direction of the tubes, wherein the separators have axially aligned holes for receiving the tubes.

2 Claims, 4 Drawing Sheets

FIG. 3
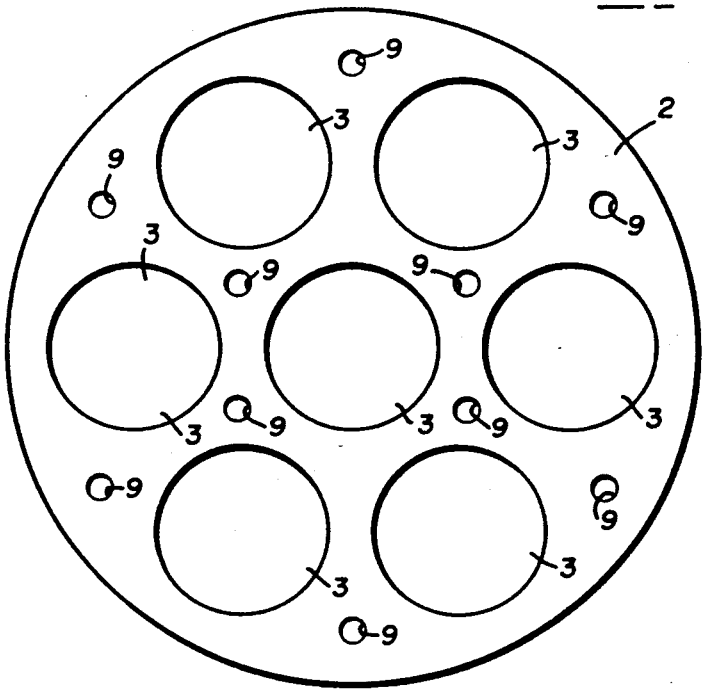
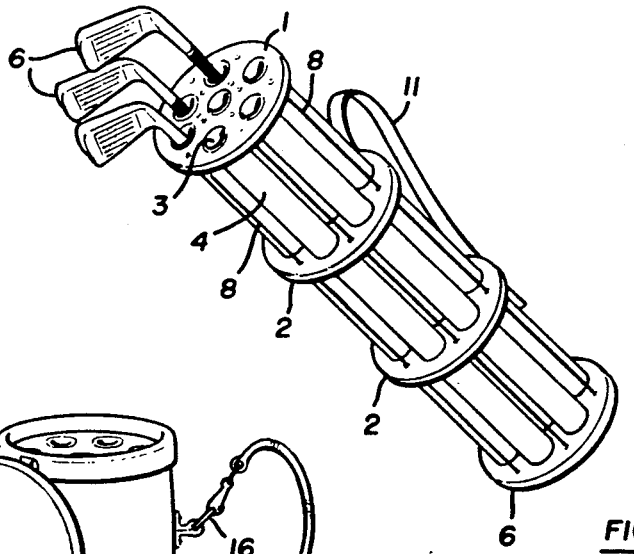
FIG. 4
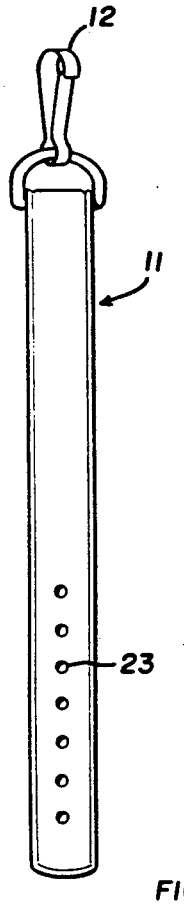
FIG. 5
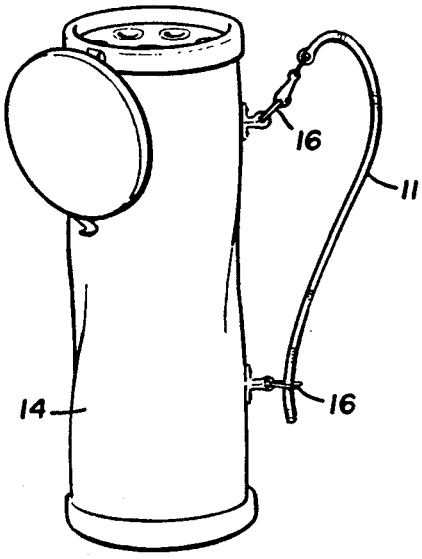
FIG. 6

GOLF CLUB HOLDER

The invention relates to a golf club holder having a plurality of tubes for receiving golf club shafts, and a bundling arrangement for bundling the tubes together in a bundle that can be readily carried on a golf course and enable a golf player to keep the clubs in an ordered position so that any club can be quickly located.

BACKGROUND OF THE PRIOR ART

Golf players usually keep the golf clubs in a cylindrical golf bag which is carried about on the golf course on a golf cart or by a shoulder or hand strap attached to the bag. The golf bag is usually sturdy and contructed to protect the clubs against the weather and rough handling.

The conventional golf bag does not help the player to keep the clubs in any particular order so that any desired club can be readily located whenever needed.

The applicant is unaware of any existing practical device or arrangement for solving the aforesaid problem and has invented a holder for carrying golf clubs on a golf course that has the advantage of enabling the player to keep clubs neatly ordered in the holder.

SUMMARY OF THE INVENTION

In accordance with the invention there is provided a golf club holder having a plurality of parallel tubes for receiving golf club shafts, combined with an arrangement for bundling the tubes, and further having a carrying arrangement for carrying the golf club holder.

According to a further feature, the golf club holder includes a plurality of perforated tube separators in the bundling arrangement spaced axially in the direction of the tubes, wherein the separators have axially aligned holes for receiving the tubes. The tubes may in one embodiment of the invention be loosely received in the aligned holes in the separators, so that tubes can be added as the user prefers to carry more clubs.

According to still another feature, the golf club holder includes a plurality of connecting rods disposed parallel with the tubes wherein each connecting rod is rigidly attached to each of the separators for maintaining the separators in axially spaced positions.

According to a further feature, the golf club holder is combined with a golf bag for receiving said golf club holder and furthermore there is provided an attaching arrangement on the golf bag for receiving respective ends of the strap.

In the golf club holder according to the invention the carrying arrangement includes two straps attached to the holder, one of which has a buckle and the other an eye for attaching the carrying strap from the golf bag to the golf club holder.

The strap of the golf club holder may further include an adjustable buckle on the strap for adjusting the length of the strap.

Further objects and advantages of this invention will be apparent from the following detailed description of a presently preferred embodiment which is illustrated schematically in the accompanying drawings.

BRIEF DESCRIPTION OF THE FIGURES

FIG. 3 is a plan view of the invention showing the bottom tube separator showing the reduced number of tubes;

FIG. 4 is a perspective view of the invention showing golf clubs inserted into the tubes;

FIG. 5 is a view of a carrying strap from a golf bag;

FIG. 6 is a perspective view of a golf bag with the golf club holder inserted into the bag;

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DESCRIPTION OF THE PREFERRED EMBODIMENTS

Figure 1:
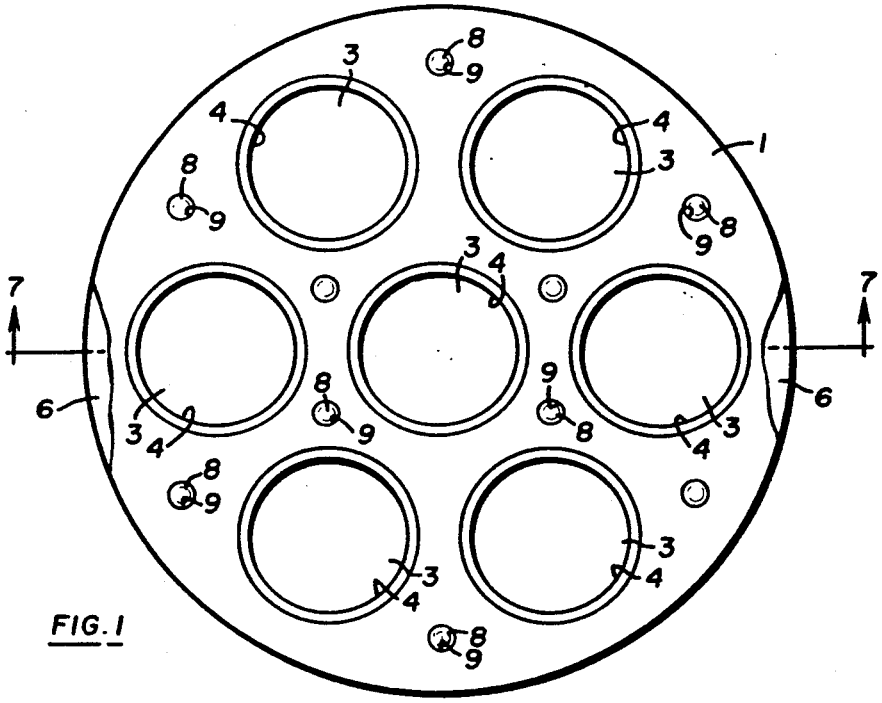
FIG. 1 is an end view of the invention showing the upper separator and the upper tube ends shown with a reduced number of tubes.
Figure 2:
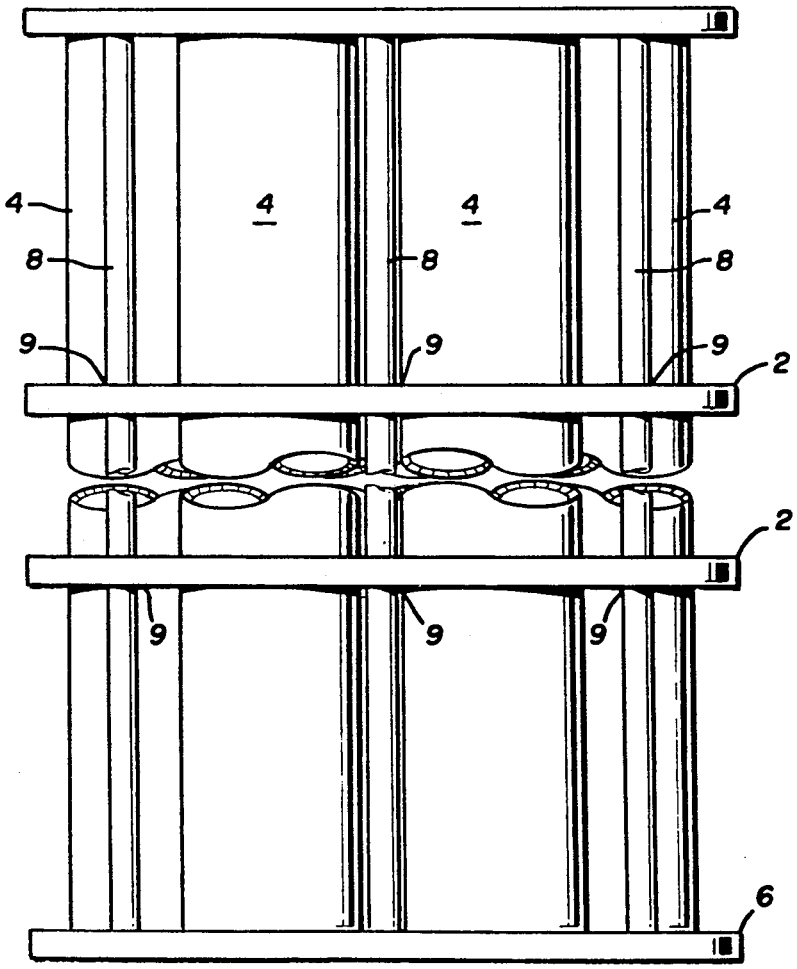
FIG. 2 is an elevational view of the invention showing the tubes separated by the tube separators.
Figure 7:
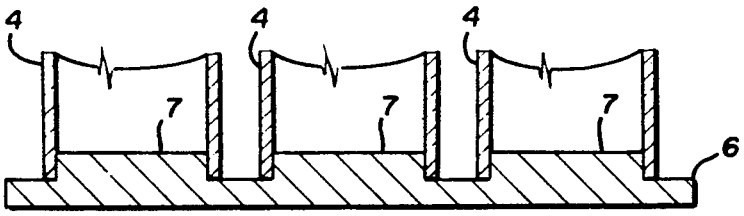
FIG. 7 is a cross-sectional view seen along the line 7—7 of FIG. 1 of the bottom separator.
Figure 9:
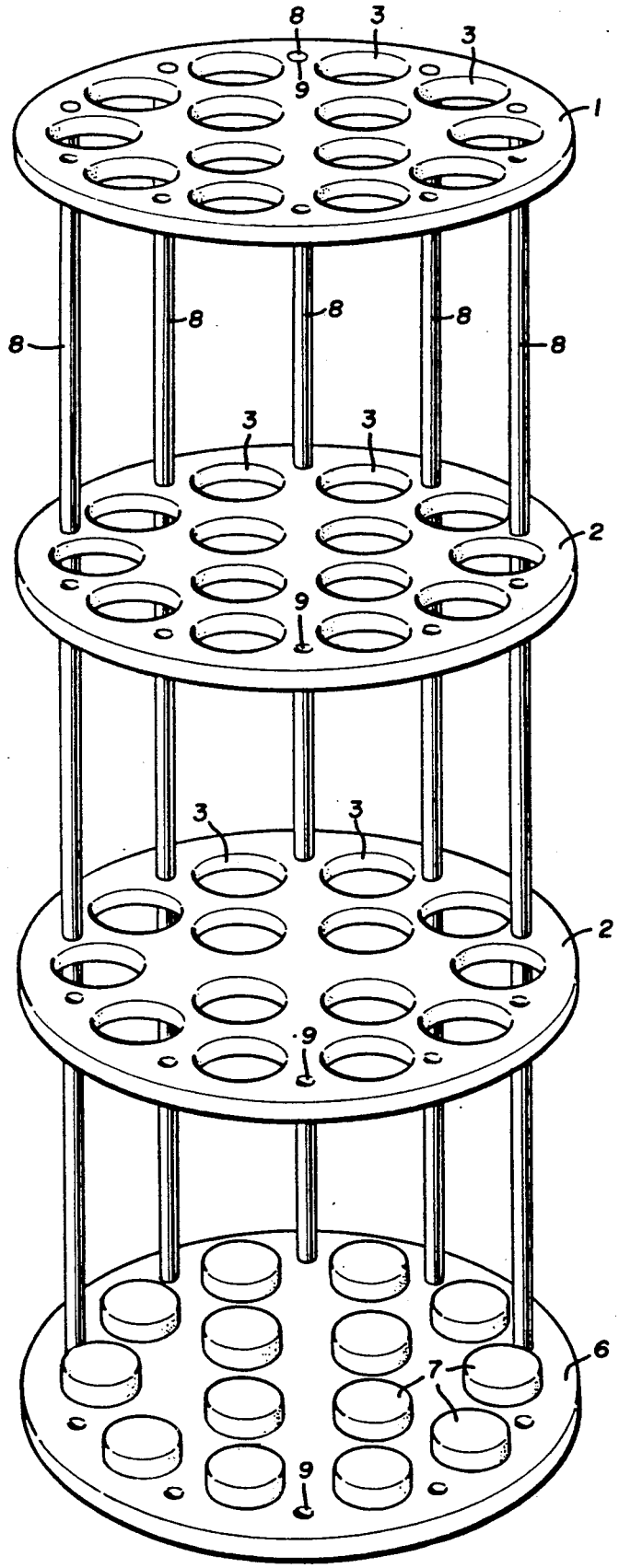
FIG. 9 is an elevational fragmentary obliquely downward looking view of the invention arranged for a larger number of tubes.

FIGS. 1 and 2 are respective top-down and elevational views of the golf club holder, wherein an upper perforated separator end plate 1 as well as intermediate perforated separators 2 have a plurality of axially aligned holes 3 that serve to receive tubes 4, each tube serving to receive the shaft of a golf club 6 as seen in FIG. 4. The number of tubes 4 is shown for the sake of clarity as seven tubes, but it can be any number of tubes depending upon the number of golf clubs a player wishes to carry on the course. FIG. 9 shows an arrangement for receiving, for example, fourteen tubes. The upper end separator 1 supports the upper end of each tube 4, and a bottom end separator 6 seen in cross-section in FIG. 7 supports the bottom end of each tube 4 by means of an upstanding projection 7 that snugly fits inside the bottom end of each tube 4. The intermediate perforated separators 2 support the tubes 4 along the body of the tubes. It follows that the respective holes 3 and the projection 7 of the bottom separator for each tube 4 must be axially aligned so as to receive the tubes.

The tubes 4 are, in a preferred embodiment of the invention, loosely fitting in the holes 3 so that tubes can be inserted in any desired number and positions up to the maximum number of tubes for which the holder is constructed. The tubes 4 can be made of plastic or lightweight metal such as aluminum alloy or the like. In this manner the tubes 4 are held together as a bundle by the separators 1, 2 and 6.

The separators 1, 2 and 6 are joined by means of a plurality of connecting rods 8 disposed axially in parallel with the tubes 4, and inserted through respective axially aligned holes 9 in the upper, intermediate and bottom separators 1, 2 and 6. The connecting rods may advantageously be made of metal, e.g. steel, and rigidly attached to each separator 1, 2 and 6 at the holes 9, for example by adhesive bonding, welding or any other suitable means of attachment.

Figure 8:
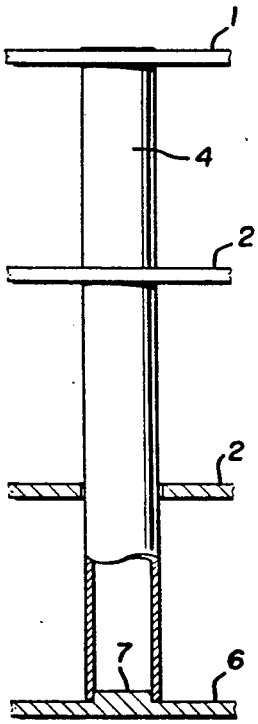
FIG. 8 is an elevational view with part of the wall of a tube broken away to show the interior of the tube supported with its bottom end in the bottom separator.

FIG. 8 is a fragmentary elevational view of a single tube 4, showing part of the upper separator 1, part of the upper intermediate separator 2, a lower intermediate separator 2 seen in cross-section, and finally a fragment of the bottom separator 6 with the upstanding projection 7 inside the tube 4 for supporting the bottom end of the tube.

Figure 10:
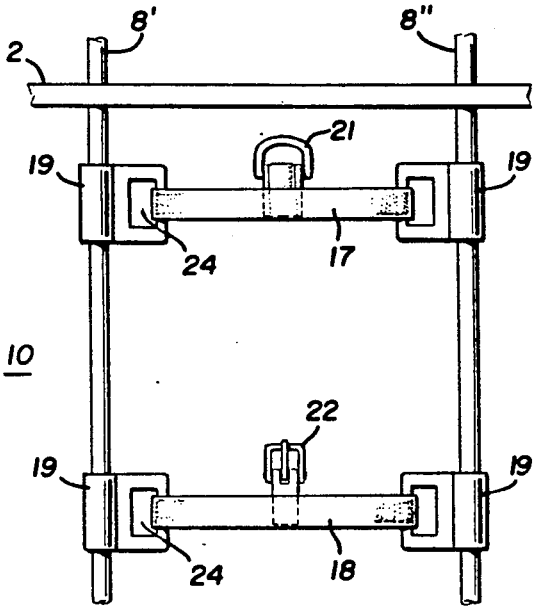
FIG. 10 is a diagrammatic view of two short straps attached to the golf club holder for attachment of the carrying strap from the golf bag.
Figure 11:
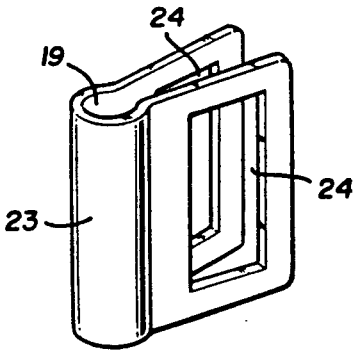
FIG. 11 is a perspective view of a strap connector for connecting the short straps to the connecting rods of the golf club holder.

In order to carry the golf club holder on the course, an arrangement including two short straps is advantageously provided as shown in FIG. 10, wherein an upper short strap 17 and a lower short strap 18 are each attached at each end to respective connecting rods 8' and 8'' by means of strap connectors 19 attached to the connecting rods 8' and 8''. The upper short strap 17 has an eye ring 21 sewn to the strap 17 for receiving a snap shackle 12 on the carrying strap 11 (FIG. 5) from the golf bag 14, while the lower short strap 18 has a buckle 22 sewn to the strap for receiving the other end of the carrying strap 11, which is provided with a row of adjusting holes 23. The strap connector 19 is shown in FIG. 11, wherein it is formed from a piece of sheet metal bent about a middle spine 23, formed to receive a connecting rod 8', 8'', and having two "windows" 24, formed to receive respective ends of the short straps 17, 18. The ends of the short straps 17, 18 pass through the windows and are sewn to themselves.

The golf club holder is advantageously combined with a carrying bag 14 of conventional construction, with an inside diameter so that the gold club holder fits snugly inside the bag. The carrying bag 14 may have rings 16 attached thereto, so that the strap 11 can be removed from the golf club holder and attached to the golf bag 14 when so desired for carrying the golf bag with the holder inside it.

I claim:

1. A golf club holder in combination with a golf bag for receiving said golf club holder comprising a plurality of substantially parallel tubes for receiving golf club handles, bundling means for bundling said tubes, and carrying means for carrying said golf club holder; a plurality of perforated tube separators in said bundling means spaced in axial direction of the tubes, each disposed perpendicularly to the axial direction of said tubes, said separators having axially aligned holes distributed across said separators for receiving said tubes, wherein said tubes have an outside diameter, and said axially aligned holes have a diameter greater than the outside diameter of said tubes for loosely receiving said tubes; a plurality of connecting rods disposed perpendicularly to the planes of said separators, each of said connecting rod rigidly attached to each of said separators for maintaining said separators in axially spaced positions; wherein said carrying means include two short straps, and an eye ring on said other short strap, a removable carrying strap attached to said short straps; said golf bag including attachment means for said carrying strap whereby said carrying strap is removable from the golf club holder and attachable to said attachment means of said golf bag.

2. A golf club holder according to claim 1 wherein the number of said holes is fourteen.

* * * * *